US009427738B2

(12) United States Patent
Yamaguchi

(10) Patent No.: US 9,427,738 B2
(45) **Date of Patent: *Aug. 30, 2016**

(54) THERMAL CYCLER AND CONTROL METHOD OF THERMAL CYCLER

(71) Applicant: Seiko Epson Corporation, Tokyo (JP)

(72) Inventor: Akemi Yamaguchi, Matsumoto (JP)

(73) Assignee: Seiko Epson Corporation (JP)

( * ) Notice: Subject to any disclaimer, the term of this patent is extended or adjusted under 35 U.S.C. 154(b) by 34 days.

This patent is subject to a terminal disclaimer.

(21) Appl. No.: 13/796,146

(22) Filed: Mar. 12, 2013

(65) Prior Publication Data

US 2013/0260449 A1 Oct. 3, 2013

(30) Foreign Application Priority Data

Mar. 30, 2012 (JP) ..... 2012-079764

(51) Int. Cl.
*B01L 7/00* (2006.01)

(52) U.S. Cl.
CPC *B01L 7/525* (2013.01); *B01L 7/54* (2013.01); *B01L 2200/0673* (2013.01); *B01L 2300/0832* (2013.01); *B01L 2300/1805* (2013.01); *B01L 2400/0457* (2013.01)

(58) Field of Classification Search
None
See application file for complete search history.

(56) References Cited

U.S. PATENT DOCUMENTS 6,875,602 B2 * 4/2005 Gutierrez ..... 435/286.2
8,932,833 B2 1/2015 Yamaguchi et al.
2002/0155475 A1 10/2002 Vischer
2007/0099189 A1 5/2007 Gomez-Elvira Rodriguez et al.
2008/0176290 A1 7/2008 Joseph et al.

(Continued)

FOREIGN PATENT DOCUMENTS

JP 2004-508837 A 3/2004
JP 2005-034121 A 2/2005

(Continued)

OTHER PUBLICATIONS

Qiagen OneStep RT—PCR Kit (Qiagen One Step RT-PCR Kit, Quick-start protocol, published Jan. 2011).*

*Primary Examiner* — Jill Warden
*Assistant Examiner* — Benjamin Whatley
(74) *Attorney, Agent, or Firm* — Harness, Dickey & Pierce, P.L.C.

(57) ABSTRACT

A thermal cycler includes an attachment unit having an insertion opening for insertion of a reaction container including a channel filled with a reaction solution containing reverse transcriptase enzyme and a liquid having a lower specific gravity than that of the reaction solution and being immiscible with the reaction solution, a first heating unit that heats a first region of the channel, a second heating unit that heats a second region of the channel nearer the insertion opening than the first region, a drive mechanism that switches arrangement of the attachment unit, the first heating unit, and the second heating unit between a first arrangement and a second arrangement, and a control unit that controls the first heating unit to be at a temperature at which reverse transcription reaction progresses and the second heating unit to be at a temperature at which the reverse transcriptase enzyme is not deactivated.

6 Claims, 11 Drawing Sheets

(56) References Cited

U.S. PATENT DOCUMENTS

| | | | | |
|---|---|---|---|---|
| 2010/0279392 | A1 | 11/2010 | Kodama et al. | |
| 2011/0183378 | A1* | 7/2011 | Takagi et al. | 435/91.2 |
| 2011/0189660 | A1* | 8/2011 | Koeda | 435/6.1 |
| 2011/0256590 | A1* | 10/2011 | Koeda | 435/91.2 |
| 2012/0122160 | A1 | 5/2012 | Saito et al. | |
| 2012/0145260 | A1* | 6/2012 | Koeda | 137/384 |
| 2012/0225001 | A1* | 9/2012 | Koeda | 422/560 |
| 2012/0301367 | A1* | 11/2012 | Koeda | 422/236 |
| 2013/0130229 | A1 | 5/2013 | Sugiyama et al. | |
| 2013/0210081 | A1* | 8/2013 | Koeda | 435/91.2 |

FOREIGN PATENT DOCUMENTS

| | | | |
|---|---|---|---|
| JP | 2008-526216 | A | 7/2008 |
| JP | 2009-136250 | | 6/2009 |
| JP | 2010-516281 | A | 5/2010 |
| JP | 2011-174734 | A | 9/2011 |
| JP | 2012-023987 | A | 2/2012 |
| WO | WO-02-22878 | | 3/2002 |
| WO | WO-2006-074217 | A2 | 7/2006 |
| WO | WO-2008-091626 | A1 | 7/2008 |
| WO | WO-2008-146754 | A1 | 12/2008 |
| WO | WO 2012073484 | A1 * | 6/2012 |

* cited by examiner

| COMPOSITION | PRESERVATIVE CONCENTRATION | FINAL CONCENTRATION | LIQUID VOLUME [uL] |
|---|---|---|---|
| SuperScript III Platinum | | | 0.2 |
| Buffer | 2x | 1x | 5 |
| F primer | 40uM | 0.8uM | 0.2 |
| R primer | 40uM | 0.8uM | 0.2 |
| Probe | 10uM | 0.2uM | 0.2 |
| Distilled Water | | | 3.2 |
| RNA | | | 1 |
| total | | | 10 |

FIG.10

| | |
|---|---|
| InfA F primer | 5'- GAT CRA TCC TGT CAC CTC TGA C -3' |
| InfA R primer | 5'- AGG GCA TTY TGG ACA AAK CGT CTA -3' |
| InfA Probe | 5'- TGC AGT CCT CGC TCA CTG GGC ACG -3' |
| SW InfA F primer | 5'- GCA CGG TCA GCA CTT ATY CTR AG -3' |
| SW InfA R primer | 5'- GTG RGC TGG GTT TTC ATT TGG TC -3' |
| SW InfA Probe | 5'- CYA CTG CAA GCC CAT ACA CAC AAG CAG CA -3' |
| SW H1 F primer | 5'- GTG CTA TAA ACA CCA GCC TYC CA -3' |
| SW H1 R primer | 5'- CGG GAT ATT CCT TAA TCC TGT RGC -3' |
| SW H1 Probe | 5'- CA GAA TAT ACA TCC RGT CAC AAT TGG ARA A -3' |
| RNaseP F primer | 5'- AGA TTT GGA CCT GCG AGC G -3' |
| RNaseP R primer | 5'- GAG CGG CTG TCT CCA CAA GT -3' |
| RNaseP Probe | 5'- TTC TGA CCT GAA GGC TCT GCG CG -3' |

FIG.11

THERMAL CYCLER AND CONTROL METHOD OF THERMAL CYCLER

BACKGROUND

1. Technical Field

The present invention relates to a thermal cycler and a control method of the thermal cycler.

2. Related Art

Recently, with development of utilization technologies of genes, medical treatment utilizing genes such as gene diagnoses and gene therapies has attracted attention, and many techniques using genes for breed identification and breed improvement have been developed in agriculture and livestock fields. As technologies for utilizing genes, a technology such as a PCR (Polymerase Chain Reaction) method has been widespread. Today, the PCR method is an essential technology in elucidation of information of biological materials.

The PCR method is a technique of amplifying target nucleic acid by applying thermal cycling to a solution containing nucleic acid as a target of amplification (target nucleic acid) and reagent (reaction solution). The thermal cycling is processing of periodically applying two or more steps of temperatures to the reaction solution. In the PCR method, generally, thermal cycling of two or three steps is applied.

In the PCR method, generally, a container for biochemical reaction called a tube or a chip for biological sample reaction (biochip) is used. However, in the technique of related art, there have been problems that large amounts of reagent etc. are necessary, equipment becomes complex for realization of thermal cycling necessary for reaction, and the reaction takes time. Accordingly, biochips and reactors for performing PCR with high accuracy in short time using extremely small amounts of reagent and specimen have been required.

In order to solve the problem, Patent Document 1 (JP-A-2009-136250) has disclosed a biological sample reactor of performing thermal cycling by rotating a chip for biological sample reaction filled with a reaction solution and a liquid being immiscible with the reaction liquid and having a lower specific gravity than that of the reaction solution around a rotation axis in the horizontal direction to move the reaction solution.

Further, a RT-PCR (Reverse Transcription Polymerase Chain Reaction) method of performing transcription reaction with RNA (ribonucleic acid) as template and performing PCR on the produced cDNA (complementary deoxyribonucleic acid) has been known.

Reverse transcriptase enzyme used in the RT-PCR method is normally not heat-resistant enzyme, and may be deactivated when subjected to a high temperature. If the reverse transcriptase enzyme is deactivated and sufficient reverse transcription reaction becomes impossible, it is impossible to accurately perform the subsequent PCR, and the reaction accuracy of RT-PCR may be lower. Here, in order to shorten the time taken for the thermal cycling, it is preferable to preheat the thermal cycler. Patent Document 1 has disclosed an example having a container unit of the thermal cycler as a slit in which the chip for biological sample reaction is inserted from a side of one heater. When the chip for biological sample reaction is put into the slit, if there is a heater at an excessively high temperature, the reaction solution is subjected to the high temperature and the reverse transcriptase enzyme may be deactivated.

SUMMARY

An advantage of some aspects of the invention is to provide a thermal cycler and a control method of the thermal cycler that can suppress reduction in reaction accuracy of RT-PCR due to deactivation of reverse transcriptase enzyme and shorten time taken for reaction (reaction time).

(1) A thermal cycler according to an aspect of the invention includes an attachment unit having an insertion opening for insertion of a reaction container including a channel filled with a reaction solution containing reverse transcriptase enzyme and a liquid having a lower specific gravity than that of the reaction solution and being immiscible with the reaction solution, the reaction solution moving close to opposed inner walls, a first heating unit that heats a first region of the channel when the reaction container is attached to the attachment unit, a second heating unit that heats a second region of the channel nearer the insertion opening than the first region when the reaction container is attached to the attachment unit, a drive mechanism that switches arrangement of the attachment unit, the first heating unit, and the second heating unit between a first arrangement and a second arrangement, and a control unit that controls the first heating unit and the second heating unit, wherein the first arrangement is an arrangement in which the first region is located in a lowermost part of the channel in a direction in which gravity acts when the reaction container is attached to the attachment unit, the second arrangement is an arrangement in which the second region is located in the lowermost part of the channel in the direction in which the gravity acts when the reaction container is attached to the attachment unit, and the control unit performs first processing of controlling a temperature of the first heating unit to be a temperature at which the reverse transcriptase enzyme has activity and controlling a temperature of the second heating unit to be a temperature at which the reverse transcriptase enzyme is not deactivated.

According to the aspect of the invention, the state in which the reaction container is held in the first arrangement and the state in which the reaction container is held in the second arrangement may be switched by switching the arrangement of the attachment unit, the first heating unit, and the second heating unit. The first arrangement is the arrangement in which the first region of the channel forming the reaction container is located in the lowermost part of the channel in the direction in which the gravity acts. The second arrangement is the arrangement in which the second region of the channel forming the reaction container is located in the lowermost part of the channel in the direction in which the gravity acts. That is, the reaction solution may be held in the first region in the first arrangement and the reaction solution may be held in the second region in the second arrangement by the action of the gravity. The first region is heated by the first heating unit and the second region is heated by the second heating unit, and thereby, the first region and the second region may be set at different temperatures. Therefore, the reaction solution may be held at a predetermined temperature while the reaction container is held in the first arrangement or the second arrangement, and the thermal cycler that can easily control the heating period may be provided. Further, in the first processing, the temperature of the first heating unit for heating the first region farther from the insertion opening is the first temperature as the temperature at which the reverse transcriptase enzyme has activity and the temperature of the second heating unit for heating the second region nearer the insertion opening is the second temperature as the temperature at which the reverse transcriptase enzyme is not deactivated, and thus, even when the reaction container is attached to the attachment unit during the first processing, the reaction solution is not subjected to a high temperature at which the reverse transcriptase enzyme is deactivated. Therefore, the deactivation of the reverse transcriptase enzyme may be suppressed, and thereby, the thermal cycler with improved reaction accuracy may be realized. Further, the first temperature is the temperature at which the reverse transcription reaction progresses by the reverse transcriptase enzyme, and thus, the reverse transcription reaction may be started more promptly than in the case where heating is started after the reaction container is attached. Therefore, the reaction time may be made shorter than that in the case where heating is started after the reaction container is attached.

(2) In the above described thermal cycler, the control unit may further control the drive mechanism, and perform second processing of controlling the drive mechanism so that the arrangement of the attachment unit, the first heating unit, and the second heating unit may be the second arrangement and controlling the temperature of the second heating unit to be a temperature at which the reverse transcriptase enzyme is deactivated after the first processing.

In the second processing, the arrangement of the attachment unit, the first heating unit, and the second heating unit is controlled to be the second arrangement, and the reaction solution is held in the second region. That is, the reaction solution is at the third temperature as the temperature at which the reverse transcriptase enzyme is deactivated. Therefore, according to the configuration described above, the reverse transcriptase enzyme may be deactivated by moving the reaction solution to the second region of the reaction container. Thus, the time taken for the case of transfer from the reverse transcription reaction to the thermal cycling of polymerase chain reaction may be made shorter than that in the case where the temperature of the first heating unit is changed to the temperature at which the reverse transcriptase enzyme is deactivated.

(3) In the above described thermal cycler, the control unit may perform third processing of controlling the drive mechanism so that the arrangement of the attachment unit, the first heating unit, and the second heating unit may be the first arrangement, and controlling the temperature of the first heating unit to be the temperature at which the reverse transcriptase enzyme has activity and controlling the temperature of the second heating unit to be the temperature at which the reverse transcriptase enzyme is deactivated after the first processing and before the second processing.

In the third processing, the arrangement of the attachment unit, the first heating unit, and the second heating unit is controlled to be the first arrangement, and the reaction solution is held in the first region. The temperature of the first heating unit in the third processing is the temperature at which the reverse transcriptase enzyme has activity, and the reverse transcription reaction progresses. Thus, according to the configuration described above, the temperature of the second heating unit for heating the second region may be changed from the second temperature to the third temperature using the time when the reaction solution is held in the first region. Therefore, when the arrangement of the attachment unit, the first heating unit, and the second heating unit is controlled to be the second arrangement in the second processing, the reverse transcriptase enzyme may be promptly deactivated.

(4) In the above described thermal cycler, the control unit may control the temperature of the first heating unit to be an annealing and elongation temperature in polymerase chain reaction in the second processing.

In the second processing, the arrangement of the attachment unit, the first heating unit, and the second heating unit is controlled to be the second arrangement, and the reaction solution is held in the second region. Thus, according to the configuration described above, the temperature of the first heating unit for heating the first region may be changed from the first temperature to the fourth temperature using the time when the reaction solution is held in the second region. Therefore, the time taken for the case of transfer from the reverse transcription reaction to the thermal cycling of polymerase chain reaction may be made shorter than that in the case where the temperature of the first heating unit is changed to the annealing and elongation temperature after the second processing.

(5) In the above described thermal cycler, the control unit may control the drive mechanism so that the arrangement of the attachment unit, the first heating unit, and the second heating unit may be the first arrangement after the second processing.

According to this configuration, the arrangement of the attachment unit, the first heating unit, and the second heating unit is controlled to be the first arrangement after the second processing, and thus, the period in which the reaction solution is held at the annealing and elongation temperature may be controlled more accurately than that in the case where the temperature of the first heating unit is controlled to be the annealing and elongation temperature after switching to the first arrangement.

(6) In the above described thermal cycler, the temperature at which the reverse transcriptase enzyme has activity may be a thermal denaturation temperature in polymerase chain reaction.

According to this configuration, when the arrangement of the attachment unit, the first heating unit, and the second heating unit is controlled to be the second arrangement, the reaction solution is held in the second region controlled at the temperature at which the reverse transcriptase enzyme is deactivated and the thermal denaturation temperature of DNA in the polymerase chain reaction. Thereby, the deactivation of the reverse transcriptase enzyme and the thermal denaturation in the polymerase chain reaction may be performed at the same step. Therefore, the time taken for the case of transfer from the reverse transcription reaction to the thermal cycling of polymerase chain reaction may be made shorter than that in the case where the temperatures of the deactivation and the thermal denaturation of the reverse transcriptase enzyme are different.

(7) A control method of a thermal cycler according to another aspect of the invention is a control method of a thermal cycler, and the thermal cycler includes an attachment unit having an insertion opening for insertion of a reaction container including a channel filled with a reaction solution containing reverse transcriptase enzyme and a liquid having a lower specific gravity than that of the reaction solution and being immiscible with the reaction solution, the reaction solution moving close to opposed inner walls, a first heating unit that heats a first region of the channel when the reaction container is attached to the attachment unit, a second heating unit that heats a second region of the channel nearer the insertion opening than the first region when the reaction container is attached to the attachment unit, and a drive mechanism that switches arrangement of the attachment unit, the first heating unit, and the second heating unit between a first arrangement and a second arrangement, the first arrangement being an arrangement in which the first region is located in a lowermost part of the channel in a direction in which gravity acts when the reaction container is attached to the attachment unit, and the second arrangement being an arrangement in which the second region is located in the lowermost part of the channel in the direction in which the gravity acts when the reaction container is attached to the attachment unit, and the control method includes controlling a temperature of the first heating unit to be a temperature at which the reverse transcriptase enzyme has activity, and controlling a temperature of the second heating unit to be a temperature at which the reverse transcriptase enzyme is not deactivated.

BRIEF DESCRIPTION OF THE DRAWINGS

The invention will be described with reference to the accompanying drawings, wherein like numbers reference like elements.

FIG. 10 is a table showing a composition of a reaction solution 140 in an example.

FIG. 11 is a table showing base sequences of forward primers (F primers), reverse primers (R primers), and probes in FIG. 10.

DESCRIPTION OF EXEMPLARY EMBODIMENTS

As below, preferred embodiments of the invention will be explained in detail using the drawings. Note that the embodiments to be explained do not unduly limit the invention described in the appended claims. Further, not all of the configurations to be explained are essential component elements of the invention.

1. Overall Configuration of Thermal Cycler According to Embodiment

Figure 1:
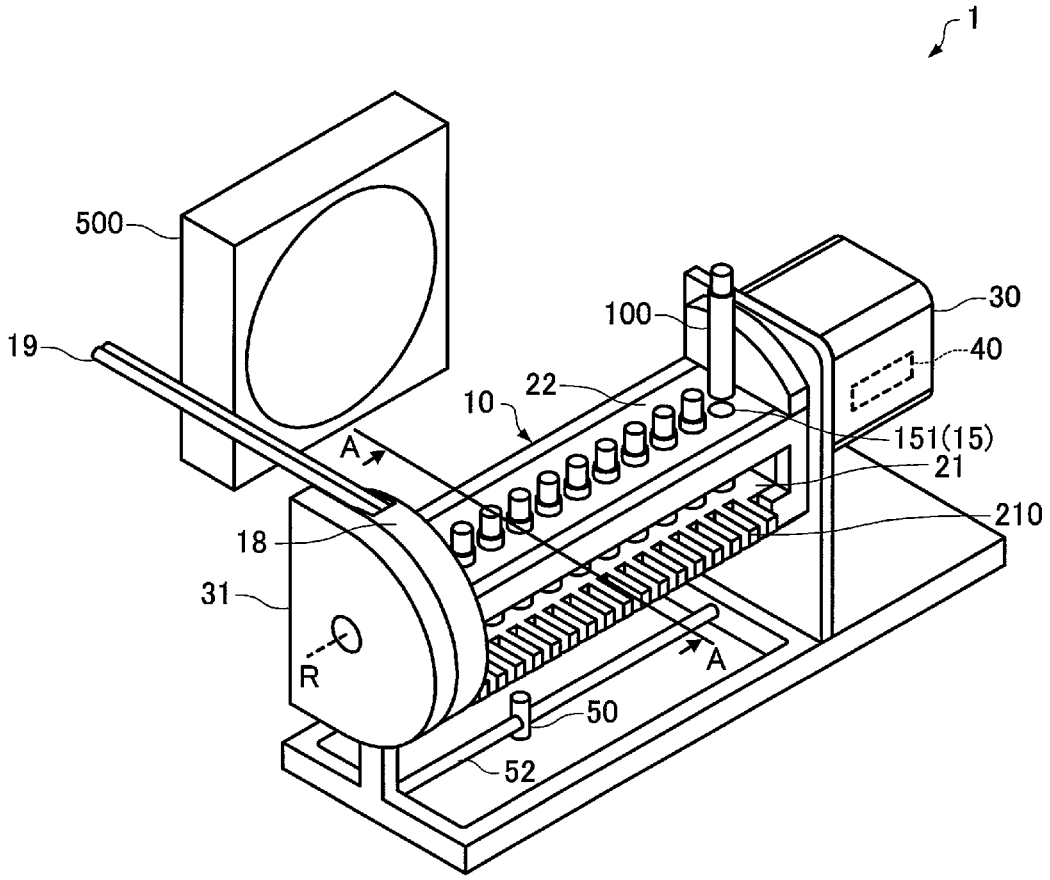
FIG. 1 is a perspective view of a thermal cycler 1 according to an embodiment.
Figure 2:
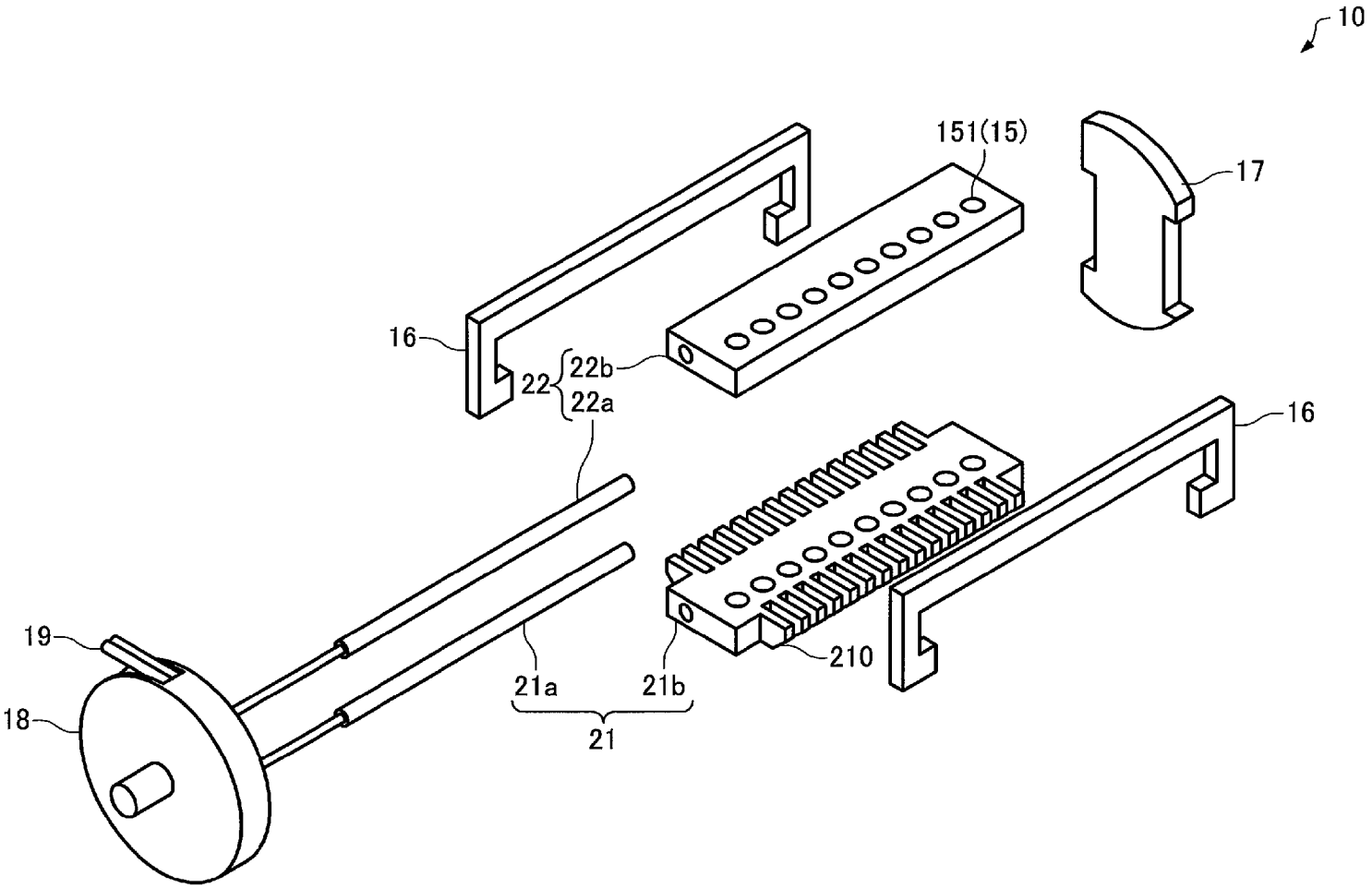
FIG. 2 is an exploded perspective view of a main body 10 of the thermal cycler 1 according to the embodiment.
Figure 3:
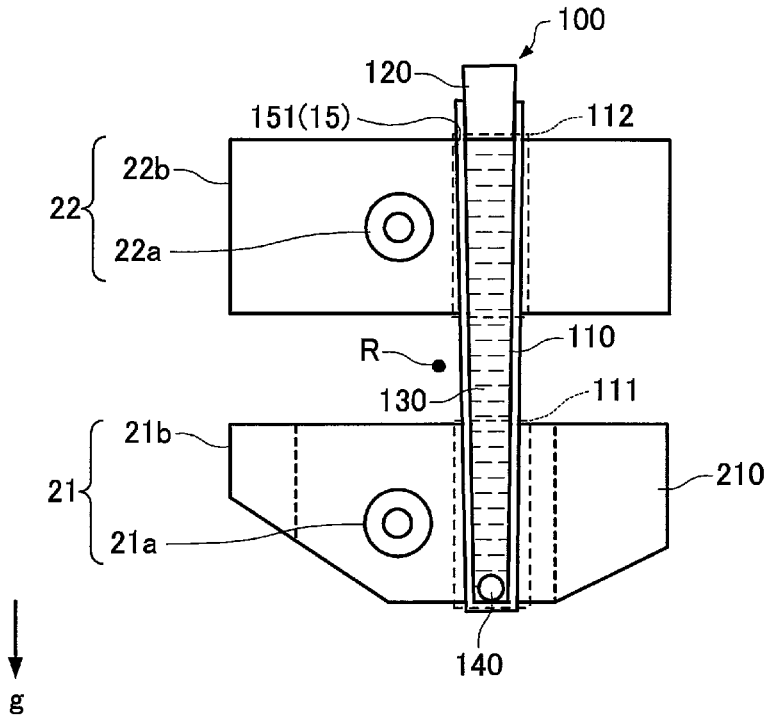
FIG. 3 is a vertical sectional view along A-A line in FIG. 1.

FIG. 1 is a perspective view of a thermal cycler 1 according to an embodiment. FIG. 2 is an exploded perspective view of a main body 10 of the thermal cycler 1 according to the embodiment. FIG. 3 is a vertical sectional view along A-A line in FIG. 1. In FIG. 3, arrow g indicates a direction in which gravity acts.

The thermal cycler 1 according to the embodiment includes an attachment unit 15 having an insertion opening 151 for insertion of a reaction container 100 including a channel 110 filled with a reaction solution 140 containing reverse transcriptase enzyme and a liquid 130 having a lower specific gravity than that of the reaction solution 140 and being immiscible with the reaction solution 140, the reaction solution moving close to opposed inner walls (the details will be described later in section of "2. Configuration of Reaction Container attached to Thermal Cycler according to Embodiment"), a first heating unit 21 that heats a first region 111 of the channel 110 when the reaction container 100 is attached to the attachment unit 15, a second heating unit 22 that heats a second region 112 of the channel 110 nearer the insertion opening 151 than the first region 111 when the reaction container 100 is attached to the attachment unit 15, a drive mechanism 30 that switches arrangement of the attachment unit 15, the first heating unit 21, and the second heating unit 22 between a first arrangement and a second arrangement, and a control unit 40 that controls the first heating unit 21 and the second heating unit 22. The first arrangement is an arrangement in which the first region 111 is located in a lowermost part of the channel 110 in a direction in which gravity acts when the reaction container 100 is attached to the attachment unit 15, and the second arrangement is an arrangement in which the second region 112 is located in the lowermost part of the channel 110 in the direction in which the gravity acts when the reaction container 100 is attached to the attachment unit 15.

In the example shown in FIG. 1, the thermal cycler 1 includes the main body 10 and the drive mechanism 30. As shown in FIG. 2, the main body 10 includes the attachment unit 15, the first heating unit 21, and the second heating unit 22.

The attachment unit 15 has a structure to which the reaction container 100 is attached. In the example shown in FIGS. 1 and 2, the attachment unit 15 of the thermal cycler 1 has a slot structure with the insertion opening 151 in which the reaction container 100 is attached by insertion from the insertion opening 151. In the example shown in FIG. 2, the attachment unit 15 has a structure in which the reaction container 100 is inserted into a hole penetrating a first heat block 21*b* of the first heating unit 21 and a second heat block 22*b* of the second heating unit 22. The first heat block 21*b* and the second heat block 22*b* will be described later. A plurality of the attachment units 15 may be provided in the main body 10, and ten attachment units 15 are provided in the main body 10 in the example shown in FIGS. 1 and 2. Further, in the example shown in FIGS. 2 and 3, the attachment unit 15 is formed as a part of the first heating unit 21 and the second heating unit 22, however, the attachment unit 15 and the first heating unit 21 and the second heating unit 22 may be formed as separate members as long as the positional relationship between them may not change when the drive mechanism 30 is operated.

The first heating unit 21 heats the first region 111 of the channel 110 of the reaction container 100 when the reaction container 100 is attached to the attachment unit 15. In the example shown in FIG. 3, the first heating unit 21 is located in a position for heating the first region 111 of the reaction container 100 in the main body 10.

The first heating unit 21 may include a mechanism of generating heat and a member of transmitting the generated heat to the reaction container 100. In the example shown in FIG. 2, the first heating unit 21 includes a first heater 21*a* as a mechanism of generating heat and the first heat block 21*b* as a member of transmitting the generated heat to the reaction container 100.

In the thermal cycler 1, the first heater 21*a* is a cartridge heater and connected to an external power supply (not shown) by a conducting wire 19. The first heater 21*a* is not limited but includes a carbon heater, a sheet heater, an IH heater (electromagnetic induction heater), a Peltier device, a heating liquid, a heating gas, etc. The first heater 21*a* is inserted into the first heat block 21*b* and the first heater 21*a* generates heat to heat the first heat block 21*b*. The first heat block 21*b* is a member of transmitting the heat generated from the first heater 21*a* to the reaction container 100. In the thermal cycler 1, the first heat block 21*b* is an aluminum block. The cartridge heater is easily temperature-controlled, and, with the cartridge heater for the first heater 21*a*, the temperature of the first heating unit 21 may be easily stabilized. Therefore, more accurate thermal cycling may be realized.

The material of the heat block may be appropriately selected in consideration of conditions of coefficient of thermal conductivity, heat retaining characteristics, ease of working, etc. For example, aluminum has a high coefficient of thermal conductivity, and, by forming the first heat block 21*b* using aluminum, the reaction container 100 may be efficiently heated. Further, unevenness in heating is hard to be produced in the heat block, and the thermal cycling with high accuracy may be realized. Furthermore, working is easy, and the first heat block 21*b* may be molded with high accuracy and the heating accuracy may be improved. Therefore, more accurate thermal cycling may be realized. Note that, for the material of the heat block, for example, copper alloy may be used or several materials may be combined.

It is preferable that the first heating unit 21 is in contact with the reaction container 100 when the attachment unit 15 is attached to the reaction container 100. Thereby, when the reaction container 100 is heated by the first heating unit 21, the heat of the first heating unit 21 may be transmitted to the reaction container 100 more stably than in the configuration in which the first heating unit 21 is not in contact with the reaction container 100, and thus, the temperature of the reaction container 100 may be stabilized. When the attachment unit 15 is formed as the part of the first heating unit 21 like in the embodiment, it is preferable that the attachment unit 15 is in contact with the reaction container 100. Thereby, the heat of the first heating unit 21 may be stably transmitted to the reaction container 100, and the reaction container 100 may be efficiently heated.

The second heating unit 22 heats the second region 112 of the channel 110 of the reaction container 100 nearer the insertion opening 151 than the first region 111 to a second temperature different from the first temperature when the attachment unit 15 is attached to the reaction container 100. In the example shown in FIG. 3, the second heating unit 22 is located in a position for heating the second region 112 of the reaction container 100 in the main body 10. The second heating unit 22 includes a second heater 22*a* and a second heat block 22*b*. The configuration of the second heating unit 22 in the embodiment is the same as that of the first heating unit 21 except that the region of the reaction container 100 to be heated and the temperature of heating are different from those of the first heating unit 21. Note that different heating mechanisms may be employed in the first heating unit 21 and the second heating unit 22. Further, the materials of the first heat block 21*b* and the second heat block 22*b* may be different.

The first heating unit 21 and the second heating unit 22 function as a temperature gradient forming section of forming a temperature gradient in a direction in which the reaction solution 140 moves for the channel 110 when the attachment unit 15 is attached to the reaction container 100. Here, "forming a temperature gradient" refers to forming a state in which a temperature changes along a predetermined direction. Therefore, "forming a temperature gradient in a direction in which the reaction solution 140 moves" refers to forming a state in which a temperature changes in a direction in which the reaction solution 140 moves. "A state in which a temperature changes along a predetermined direction" may refer to a state in which a temperature monotonically becomes higher or lower along a predetermined direction, or a state in which a temperature change is changed in the middle from the change to be higher to the change to be lower or from the change to be lower to the change to be higher along a predetermined direction. In the main body 10 of the thermal cycler 1, the first heating unit 21 is located at the side farther from the insertion opening 151 of the attachment unit 15 and the second heating unit 22 is located at the side nearer the insertion opening 151 of the attachment unit 15.

Further, the first heating unit 21 and the second heating unit 22 are provided separately from each other in the main body 10. Thereby, the first heating unit 21 and the second heating unit 22 controlled at the different temperatures from each other are hard to affect each other, and the temperatures of the first heating unit 21 and the second heating unit 22 may be easily stabilized. A spacer may be provided between the first heating unit 21 and the second heating unit 22. In the main body 10 of the thermal cycler 1, the first heating unit 21 and the second heating unit 22 are fixed on their peripheries by a fixing member 16, a flange 17, and a flange 18. The flange 18 is supported by a bearing 31. Note that the number of heating units may be an arbitrary number equal to or more than two as long as the temperature gradient is formed to a degree that may secure desired reaction accuracy.

The temperatures of the first heating unit 21 and the second heating unit 22 may be controlled by a temperature sensor (not shown) and the control unit 40 to be described later. It is preferable that the temperatures of the first heating unit 21 and the second heating unit 22 are set so that the reaction container 100 may be heated to a desired temperature. The details of the control of the temperatures of the first heating unit 21 and the second heating unit 22 will be described in the section of "3. Control Example of Thermal Cycler". Note that it is only necessary that the temperatures of the first heating unit 21 and the second heating unit 22 are controlled so that the first region 111 and the second region 112 of the reaction container 100 may be heated to desired temperatures. For example, in consideration of the material and the size of the reaction container 100, the temperatures of the first region 111 and the second region 112 may be heated to the desired temperatures more accurately. In the embodiment, the temperatures of the first heating unit 21 and the second heating unit 22 are measured by a temperature sensor. The temperature sensor of the embodiment is a thermocouple. Note that the temperature sensor is not limited but may include a temperature sensing resistor or a thermistor, for example.

The drive mechanism 30 switches arrangement of the attachment unit 15, the first heating unit 21, and the second heating unit 22 between the first arrangement and the second arrangement different from the first arrangement. In the embodiment, the drive mechanism 30 is a mechanism of rotating the attachment unit 15, the first heating unit 21, and the second heating unit 22 around the rotation axis R having a component perpendicular to the direction in which the gravity acts and a component perpendicular to the direction in which the reaction solution 140 moves in the channel 110 when the attachment unit 15 is attached to the reaction container 100.

The direction "having a component perpendicular to the direction in which the gravity acts" refers to a direction having a component perpendicular to the direction in which the gravity acts when the direction is expressed by a vector sum of "a component in parallel to the direction in which the gravity acts" and "a component perpendicular to the direction in which the gravity acts".

The direction "having a component perpendicular to the direction in which the reaction solution 140 moves in the channel 110" refers to a direction having a component perpendicular to the direction in which the reaction solution 140 moves in the channel 110 when the direction is expressed by a vector sum of "a component in parallel to the direction in which the reaction solution 140 moves in the channel 110" and "a component perpendicular to the direction in which the reaction solution 140 moves in the channel 110".

In the thermal cycler 1 of the embodiment, the drive mechanism 30 rotates the attachment unit 15, the first heating unit 21, and the second heating unit 22 around the same rotation axis R. Further, in the embodiment, the drive mechanism 30 includes a motor and a drive shaft (not shown), and the drive shaft and the flange 17 of the main body 10 are connected. When the motor of the drive mechanism 30 is operated, the main body 10 is rotated around the drive axis as the rotation axis R. In the embodiment, ten attachment units 15 are provided along the direction of the rotation axis R. Note that, as the drive mechanism 30, not limited to the motor, but, for example, a handle, a spiral spring, or the like may be employed.

The thermal cycler 1 includes the control unit 40. The control unit 40 controls the first heating unit 21 and the second heating unit 22. The control unit 40 may further control the drive mechanism 30. A control example by the control unit 40 will be described in detail in the section of "3. Control Example of Thermal Cycler". The control unit 40 may be adapted to be realized by a dedicated circuit and perform the control to be described later. Further, the control unit 40 may be adapted to function as a computer using a CPU (Central Processing Unit), for example, by executing control programs stored in a memory device such as a ROM (Read Only Memory) or a RAM (Random Access Memory) and perform the control to be described later. In this case, the memory device may have a work area that temporarily stores intermediate data and control results with the control. Further, the control unit 40 may have a timer for measuring time. Furthermore, the control unit 40 may control the first heating unit 21 and the second heating unit 22 to desired temperatures based on the output of the above described temperature sensor (not shown).

It is preferable that the thermal cycler 1 includes a structure of holding the reaction container 100 in a predetermined position with respect to the first heating unit 21 and the second heating unit 22. Thereby, a predetermined regions of the reaction container 100 may be heated by the first heating unit 21 and the second heating unit 22. More specifically, the first region 111 and the second region 112 of the channel 110 forming the reaction container 100 may be heated by the first heating unit 21 and the second heating unit 22, respectively. In the embodiment, by appropriately setting the sizes of through holes provided in the first heat block 21*b* and the second heat block 22*b* (the diameter of the attachment unit 15), the reaction container 100 may be held in a predetermined position with respect to the first heating unit 21 and the second heating unit 22.

The first heat block 21*b* may have a structure with fins 210. Thereby, the surface area of the first heating unit becomes larger and the time taken for changing the temperature of the first heating unit 21 from the higher temperature to the lower temperature becomes shorter.

The thermal cycler 1 may include a fan 500 that blows air to the first heating unit 21 and the second heating unit 22. By blowing air, the heat transfer between the first heating unit 21 and the second heating unit 22 may be suppressed. Therefore, the first heating unit 21 and the second heating unit 22 controlled at the different temperatures from each other become harder to affect each other, and thus, the temperatures of the first heating unit 21 and the second heating unit 22 may be easily stabilized.

As shown in FIG. 1, the thermal cycler 1 may include a measurement unit 50. In the embodiment, the measurement unit 50 includes a fluorescence detector. Thereby, the thermal cycler 1 may be used for application with fluorescence measurement such as real-time PCR, for example. The number of measurement units 50 is arbitrary as long as the measurement may be performed without difficulty. In the example shown in FIG. 1, the fluorescence measurement is performed while one measurement unit 50 is moved along a slide 52.

It is more preferable that the measurement unit 50 is located at the side nearer the first heating unit 21 than at the side nearer the second heating unit 22. Thereby, the measurement unit hardly becomes an obstacle to the operation when the attachment unit 15 is attached to the reaction container 100. Further, the measurement unit 50 may be provided to measure light from the first region 111 of the reaction container 100. When the temperature of the first heating unit 21 is set to an annealing and elongation temperature (a temperature at which annealing and elongation reaction progress) of PCR, appropriate fluorescence measurement may be performed in real-time PCR. Furthermore, when a reaction container 100 with a lid (sealing part 120) to be described later is used, more appropriate fluorescence measurement may be performed in the first region 110 at the side farther from the lid than in the second region 112 at the side nearer the lid because there are less members between the measurement unit 50 and the reaction solution 140.

As described above, when the thermal cycler 1 is used for real-time PCR, in a period in which thermal cycling necessary for PCR is applied to the reaction solution 140, it is preferable that the measurement unit 50 is provided at the side nearer the first heating unit 21 and the first heating unit 21 is set to the annealing and elongation temperature of PCR (about 50° C. to 75° C.). In this case, the second heating unit 22 nearer the insertion opening 151 is set to a thermal denaturation temperature (about 90° C. to 100° C.) higher than the annealing and elongation temperature of PCR.

Figure 4:
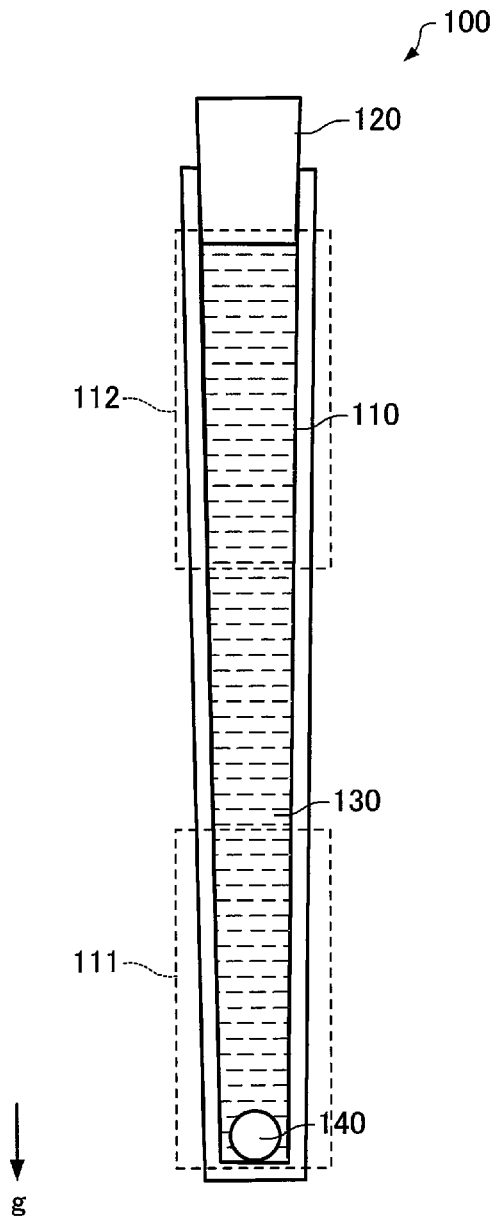
FIG. 4 is a sectional view showing a configuration of a reaction container 100 to be attached to the thermal cycler 1 according to the embodiment.

2. Configuration of Reaction Container Attached to Thermal Cycler According to Embodiment FIG. 4 is a sectional view showing a configuration of the reaction container 100 attached to the thermal cycler 1 according to the embodiment. In FIG. 4, arrow g indicates a direction in which gravity acts.

The reaction container 100 includes the channel 110 filled with the reaction solution 140 containing the reverse transcriptase enzyme and the liquid 130 having a different specific gravity from that of the reaction solution 140 and being immiscible with the reaction solution 140 (hereinafter, referred to as "liquid 130"), in which the reaction solution 140 moves along the opposed inner walls. In the embodiment, the liquid 130 is a liquid having a lower specific gravity than that of the reaction solution 140 and being immiscible with the reaction solution 140. Note that, as the liquid 130, for example, a liquid being immiscible with the reaction solution 140 and having a higher specific gravity than that of the reaction solution 140 may be employed. In the example shown in FIG. 4, the reaction container 100 includes the channel 110 and the sealing part 120. The channel 110 is filled with the reaction solution 140 and the liquid 130, and sealed by the sealing part 120.

The channel 110 is formed so that the reaction solution 140 may move along the opposed inner walls. Here, "opposed inner walls" of the channel 110 refer to two regions having an opposed positional relationship on the wall surfaces of the channel 110. "Along" refers to a state in which a distance from the reaction solution 140 to the wall surface of the channel 110 is short, and includes a state in which the reaction solution 140 is in contact with the wall surface of the channel 110. Therefore, "the reaction solution 140 moves along the opposed inner walls" refers to "the reaction solution 140 moves in a state in which the distances from the wall surface of the channel 110 to both two regions in the opposed positional relationship are short". In other words, the distance between the opposed two inner walls of the channel 110 is a distance to a degree that the reaction solution 140 moves along the inner walls.

When the channel 110 of the reaction container 100 has the above described shape, the direction in which the reaction solution 140 moves within the channel 110 may be regulated, and thus, the path in which the reaction solution 140 moves within the channel 110 may be defined to some degree. Thereby, the time taken for the reaction solution 140 to move within the channel 110 may be restricted within a certain range. Therefore, it is preferable that the distance between the opposed two inner walls of the channel 110 is a distance to a degree at which variations in thermal cycling conditions applied to the reaction solution 140 produced by variations in time for the reaction solution 140 to move within the channel 110 may satisfy desired accuracy, i.e., a degree at which the reaction result may satisfy desired accuracy. More specifically, it is desirable that the distance in the direction perpendicular to the direction in which the reaction solution 140 between the opposed two inner walls of the channel 110 moves is a distance to a degree not exceeding two or more droplets of the reaction solution 140.

In the example shown in FIG. 4, the outer shape of the reaction container 100 is a circular truncated cone shape, and the channel 110 in the direction along the center axis (the vertical direction in FIG. 4) as the longitudinal direction is formed. The shape of the channel 110 is a circular truncated cone shape with a section in the direction perpendicular to the longitudinal direction of the channel 110, i.e., a section perpendicular to the direction in which the reaction solution 140 moves in a certain region of the channel 110 (this refers to "section" of the channel 110) in a circular shape. Therefore, in the reaction container 100, the opposed inner walls of the channel 110 are regions containing two points on the wall surface of the channel 110 opposed with the center of the section of the channel 110 in between. Further, "the direction in which the reaction solution 140 moves" is the longitudinal direction of the channel 110.

Note that the shape of the channel 110 is not limited to the truncated cone shape, but may be a columnar shape, for example. Further, the section shape of the channel 110 is not limited to the circular shape, but may be any of a polygonal shape or an oval shape as long as the reaction solution 140 may move along the opposed inner walls. For example, when the section of the channel 110 of the reaction container 100 has a polygonal shape, if a channel having a circular section inscribed in the channel 110 is assumed, "opposed inner walls" are opposed inner walls of the channel. That is, it is only necessary that the channel 110 is formed so that the reaction solution 140 may move along opposed inner walls of a virtual channel having a circular section inscribed in the channel 110. Thereby, even when the section of the channel 110 has a polygonal shape, a path in which the reaction solution 140 moves between the first region 111 and the second region 112 may be defined to some degree. Therefore, the time taken for the reaction solution 140 to move between the first region 111 and the second region 112 may be restricted within a certain range.

The first region 111 of the reaction container 100 is a partial region of the channel 110 to be heated by the first heating unit 21. The second region 112 is a partial region of the channel 110 different from the first region 111 to be heated by the second heating unit 22. In the example shown in FIG. 4, the first region 111 is a region containing one end part in the longitudinal direction of the channel 110, and the second region 112 is a region containing the other end part in the longitudinal direction of the channel 110. In the example shown in FIG. 4, the region surrounded by a dotted line containing the end part at the side farther from the sealing part 120 of the channel 110 is the first region 111, and the region surrounded by a dotted line containing the end part at the side nearer the sealing part 120 of the channel 110 is the second region 112. In the thermal cycler 1 according to the embodiment, the first heating unit 21 heats the first region 111 of the reaction container 100 and the second heating unit 22 heats the second region 112 of the reaction container 100, and thereby, a temperature gradient is formed in the direction in which the reaction solution 140 moves with respect to the channel 110 of the reaction container 100.

The channel 110 is filled with the liquid 130 and the reaction solution 140. The liquid 130 has a property of being immiscible, i.e., unmixed with the reaction solution 140, and the reaction solution 140 is held in droplets in the liquid 130 as shown in FIG. 4. The reaction solution 140 has the higher specific gravity than that of the liquid 130 and is located in the lowermost region of the channel 110 in the direction in which the gravity acts. As the liquid 130, for example, dimethyl silicone oil or paraffin oil may be used. The reaction solution 140 is a liquid containing components necessary for reaction. When the reaction is RT-PCR, the reaction solution 140 contains RNA as template of the reverse transcription, DNA polymerase necessary for amplification of reverse-transcribed cDNA, primer etc. in addition to the reverse transcriptase enzyme. For example, when PCR is performed using an oil as the liquid 130, it is preferable that the reaction solution 140 is a solution containing the above described components.

3. Control Example of Thermal Cycler

Figure 5:
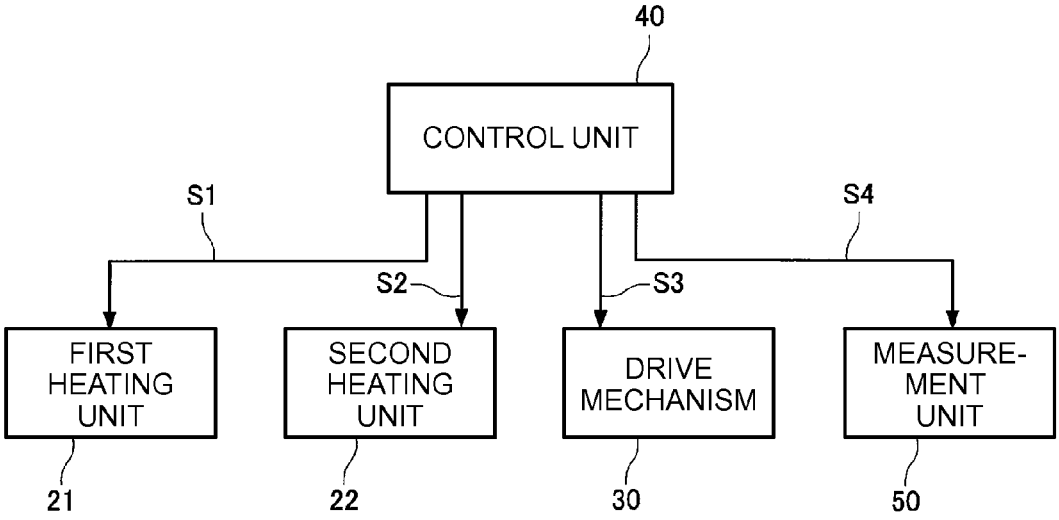
FIG. 5 is a functional block diagram of the thermal cycler 1 according to the embodiment.

FIG. 5 is a functional block diagram of the thermal cycler 1 according to the embodiment. The control unit 40 controls the temperature of the first heating unit 21 by outputting a control signal S1 to the first heating unit 21. The control unit 40 controls the temperature of the second heating unit 22 by outputting a control signal S2 to the second heating unit 22. The control unit 40 controls the drive mechanism 30 by outputting a control signal S3 to the drive mechanism 30. The control unit 40 controls the measurement unit 50 by outputting a control signal S4 to the measurement unit 50.

Next, a control example of the thermal cycler 1 according to the embodiment will be explained. As below, control by the drive mechanism 30 to rotate the attachment unit 15, the first heating unit 21, and the second heating unit 22 between the first arrangement and the second arrangement different from the first arrangement in the lowermost position in the direction in which the gravity acts within the channel 110 when the attachment unit 15 is attached to the reaction container 100 will be explained an example.

Figure 6A:
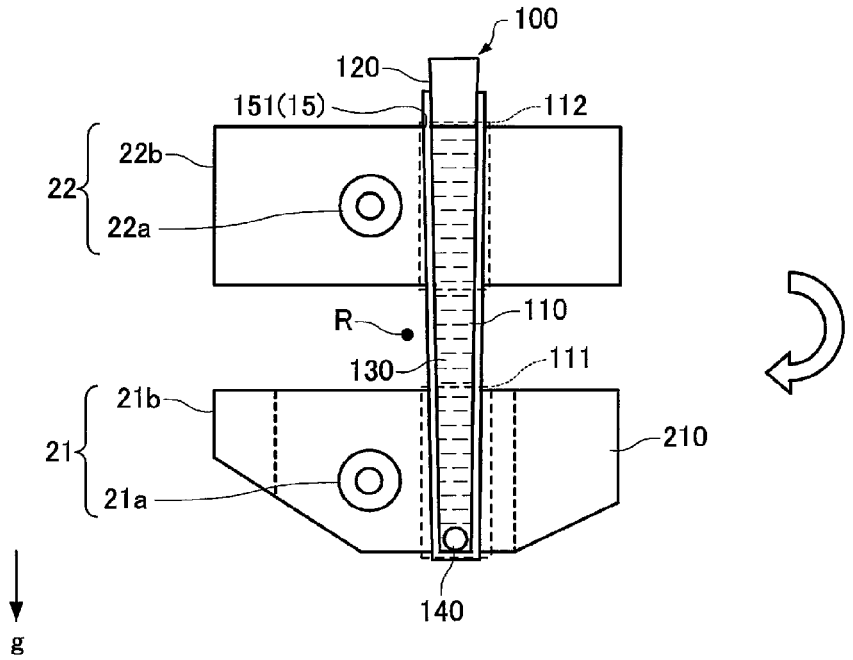
FIG. 6A is a sectional view schematically showing a section in a plane passing through the A-A line of FIG. 1A and perpendicular to a rotation axis R in a first arrangement.
Figure 6B:
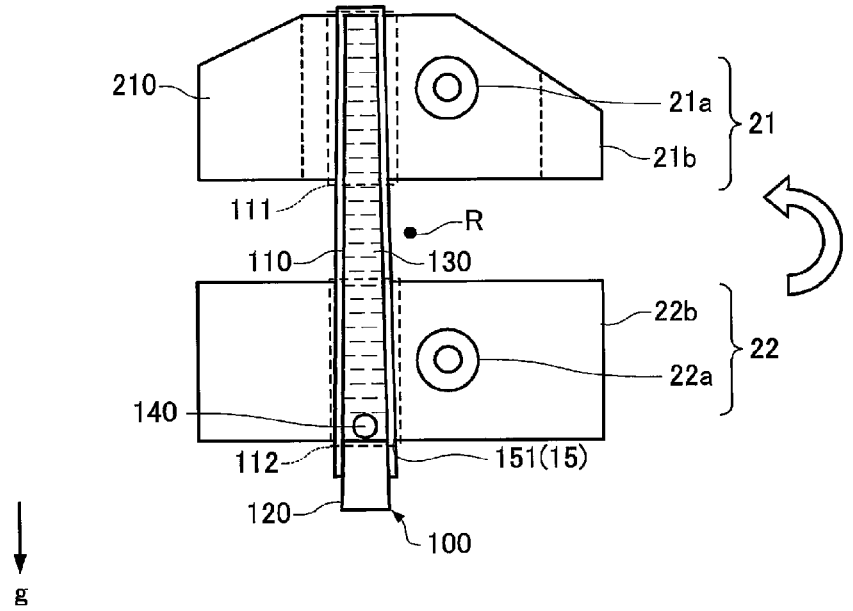
FIG. 6B is a sectional view schematically showing a section in the plane passing through the A-A line of FIG. 1A and perpendicular to the rotation axis R in a second arrangement.

FIG. 6A is a sectional view schematically showing a section in a plane passing through the A-A line of FIG. 1A and perpendicular to a rotation axis R in the first arrangement, and FIG. 6B is a sectional view schematically showing a section in the plane passing through the A-A line of FIG. 1A and perpendicular to the rotation axis R in the second arrangement. In FIGS. 6A and 6B, white arrows indicate rotation directions of the main body 10 and arrows g indicate the direction in which the gravity acts.

As shown in FIG. 6A, the first arrangement is an arrangement in which, when the attachment unit 15 is attached to the reaction container 100, the first region 111 is located in the lowermost part of the channel 110 in the direction in which the gravity acts. In the example shown in FIG. 6A, in the first arrangement, the reaction solution 140 having the higher specific gravity than that of the liquid 130 exists in the first region 111. Further, as shown in FIG. 6B, the second arrangement is an arrangement in which, when the attachment unit 15 is attached to the reaction container 100, the second region 112 is located in the lowermost part of the channel 110 in the direction in which the gravity acts. In the example shown in FIG. 6B, in the second arrangement, the reaction solution 140 having the higher specific gravity than that of the liquid 130 exists in the second region 112.

In this manner, the drive mechanism 30 rotates the attachment unit 15, the first heating unit 21, and the second heating unit 22 between the first arrangement and the second arrangement different from the first arrangement, and thereby, thermal cycling may be applied to the reaction solution 140.

According to the embodiment, by switching the arrangement of the attachment unit 15, the first heating unit 21, and the second heating unit 22, the state in which the reaction container 100 is held in the first arrangement and the state in which the reaction container 100 is held in the second arrangement may be switched. The first arrangement is the arrangement in which the first region 111 of the channel 110 forming the reaction container 100 is located in the lowermost part of the channel 110 in a direction in which the gravity acts. The second arrangement is the arrangement in which the second region 112 of the channel 110 forming the reaction container 100 is located in the lowermost part of the channel 110 in the direction in which the gravity acts. That is, the reaction solution 140 may be held in the first region 111 in the first arrangement and the reaction solution 140 may be held in the second region 112 in the second arrangement by the action of the gravity. The first region 111 is heated by the first heating unit 21 and the second region 112 is heated by the second heating unit 22, and thereby, the first region 111 and the second region 112 may be set at different temperatures. Therefore, while the reaction container 100 is held in the first arrangement or the second arrangement, the reaction solution 140 may be held at a predetermined temperature, and thus, the thermal cycler 1 that can easily control the heating period may be provided.

The drive mechanism 30 may rotate the attachment unit 15, the first heating unit 21, and the second heating unit 22 in opposite directions when rotating them from the first arrangement to the second arrangement and when rotating them from the second arrangement to the first arrangement. Thereby, a special mechanism for reducing twisting of wires such as the conducting wire 19 caused by rotation is unnecessary. Therefore, the thermal cycler 1 suitable for downsizing may be realized. Further, it is preferable that the number of rotations for rotation from the first arrangement to the second arrangement and the number of rotations for rotation from the second arrangement to the first arrangement are less than one (the rotation angle is less than 360°). Thereby, the degree of twisting of the wires may be reduced. Alternately, as shown in FIGS. 1 and 2, the configuration in which the flange 18 can take up the conducting wire 19 may be employed.

Figure 7:
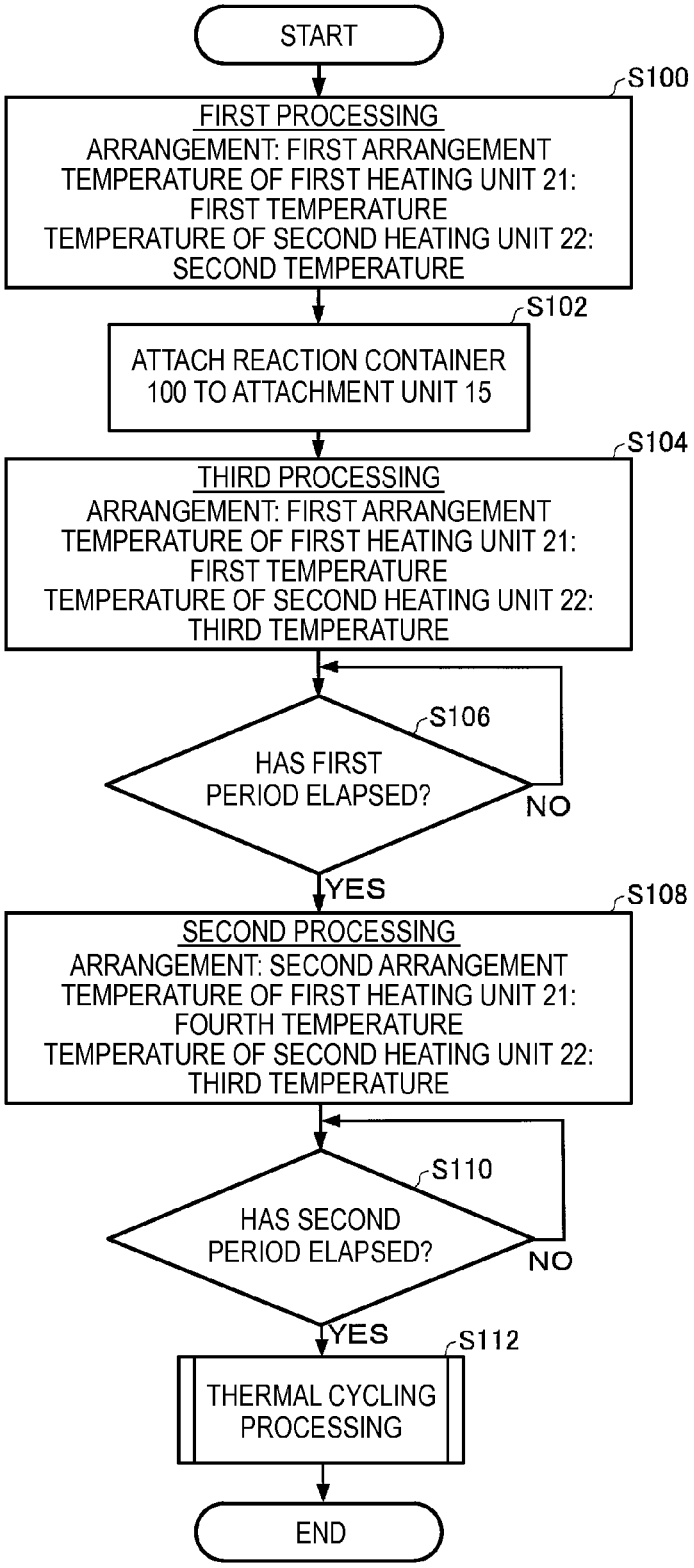
FIG. 7 is a flowchart for explanation of an example of a control method of the thermal cycler 1 according to the embodiment.
Figure 8:
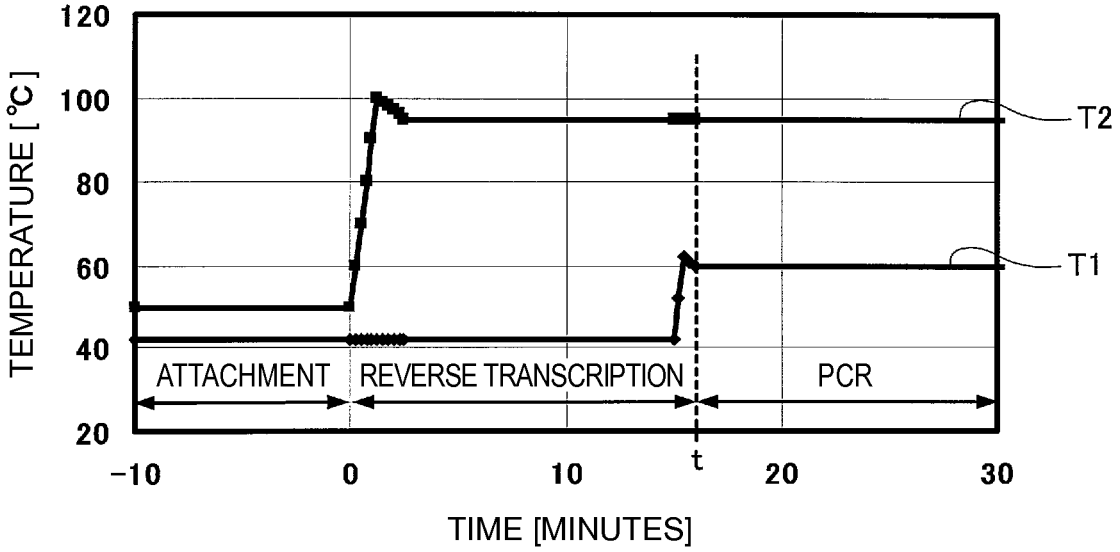
FIG. 8 is a graph showing changes over time of temperature T1 of a first heating unit 21 and temperature T2 of a second heating unit 22 in the control method shown in FIG. 7.

Next, an example of a control method of the thermal cycler 1 will be explained by taking 1step RT-PCR as an example. FIG. 7 is a flowchart for explanation of the example of the control method of the thermal cycler 1 according to the embodiment. FIG. 8 is a graph showing changes over time of the temperature T1 of the first heating unit 21 and the temperature T2 of the second heating unit 22 in the control method shown in FIG. 7. The horizontal axis of FIG. 8 indicates time (min) and the vertical axis indicates temperature (° C.).

RT-PCR is a technique for detection or quantitative determination of RNA. Reverse transcription to DNA is performed using reverse transcriptase enzyme with RNA as template, and cDNA synthesized by the reverse transcription is amplified by PCR. In typical RT-PCR, the step of reverse transcription reaction and the step of PCR are independent, and the container is replaced or reagent is added between the step of reverse transcription reaction and the step of PCR. On the other hand, in 1step RT-PCR, reverse transcription and PCR reactions are continuously performed using special reagent. Known reagent may be used for the reagent of the 1step RT-PCR.

In FIG. 7, first, the control unit 40 performs first processing of controlling the temperature T1 of the first heating unit 21 to be a temperature at which the reverse transcriptase enzyme has activity (first temperature), and controlling the temperature T2 of the second heating unit 22 to be a temperature at which the reverse transcriptase enzyme is not deactivated (second temperature) (step S100). Further, in the example shown in FIG. 7, at step S100, the control unit 40 controls the drive mechanism 30 so that the arrangement of the attachment unit 15, the first heating unit 21, and the second heating unit 22 may be the first arrangement. Note that, at the respective steps, "the control unit controls (an object to be controlled)" refers to both the case where the control unit controls the object to be controlled in a different state from that at the previous step and the case where the control unit maintains the object to be controlled in the same state as that at the previous step.

"The temperature at which the reverse transcriptase enzyme has activity" refers to a temperature at which the activity of the reverse transcriptase enzyme contained in the reaction solution is larger than zero unit. It is preferable that the temperature at which the reverse transcriptase enzyme has activity is a temperature at which the reverse transcriptase enzyme is not deactivated. The temperature at which the reverse transcriptase enzyme is not deactivated is a temperature depending on the type of the reverse transcriptase enzyme, and generally within a range from 20° C. to 70° C. It is preferable that the temperature T1 of the first heating unit 21 is controlled to be a temperature at which reverse transcription reaction progresses (a temperature preferable for reverse transcription reaction). The temperature at which reverse transcription reaction progresses is generally within a range from 40° C. to 50° C. It is preferable that the temperature T1 of the first heating unit 21 is controlled to an optimum temperature defined with respect to each type of reverse transcriptase enzyme. In the example shown in FIG. 8, 42° C. is employed as the first temperature.

At a temperature exceeding 70° C., the reverse transcriptase enzyme is easily deactivated and deteriorated. In the example shown in FIG. 8, 50° C. is employed as the second temperature. Note that "the reverse transcriptase enzyme is deactivated" refers to that enzyme activity is reduced or lost and the enzyme does not exhibit its own activity even when the experimental condition is adjusted. In this specification, it refers to a state in which the activity of the reverse transcriptase enzyme contained in the reaction solution 140 measured at the optimum temperature of the reverse transcriptase enzyme has been lower than the activity expected for the reverse transcriptase enzyme in the environment (the condition of pH or the like) of the reaction solution. "The temperature at which the reverse transcriptase enzyme is not deactivated" includes the case where the reverse transcriptase enzyme exhibits activity of 100% of the expected enzyme activity and the case where the activity is lower to a degree acceptable in RT-PCR (the case where part of the contained reverse transcriptase enzyme is deactivated).

After step S100, the reaction container 100 is attached to the attachment unit 15 (step S102). A user inserts the reaction container 100 from the insertion opening 151 of the attachment unit 15, and thereby, attaches the reaction container 100 to the attachment unit 15.

In the first processing, the temperature T1 of the first heating unit 21 for heating the first region 111 farther from the insertion opening 151 is the first temperature as the temperature at which the reverse transcriptase enzyme has activity and the temperature T2 of the second heating unit 22 for heating the second region 112 nearer the insertion opening 151 is the second temperature as the temperature at which the reverse transcriptase enzyme is not deactivated, and thus, even when the reaction container 100 is attached to the attachment unit during the first processing, the reaction solution 140 is not subjected to a high temperature at which the reverse transcriptase enzyme is deactivated. Therefore, the deactivation of the reverse transcriptase enzyme may be suppressed, and thereby, the thermal cycler 1 with improved reaction accuracy may be realized. Further, the first temperature is the temperature at which the reverse transcription reaction progresses by the reverse transcriptase enzyme, and thus, the reverse transcription reaction may be started more promptly than in the case where heating is started after the reaction container 100 is attached. Therefore, the reaction time may be made shorter than that in the case where heating is started after the reaction container 100 is attached.

In FIG. 7, after step S102, the control unit 40 may perform third processing of controlling the drive mechanism 30 so that the arrangement of the attachment unit 15, the first heating unit 21, and the second heating unit 22 may be the first arrangement, and controlling the temperature T1 of the first heating unit 21 to be the temperature at which the reverse transcriptase enzyme has activity (first temperature) and the temperature T2 of the second heating unit 22 to be a temperature at which the reverse transcriptase enzyme is deactivated (third temperature) (step S104).

"The temperature at which the reverse transcriptase enzyme is deactivated" is an temperature depending on the type of the reverse transcriptase enzyme, and generally a temperature over 70° C. In the example shown in FIG. 8, 95° C. is employed as the third temperature.

In the third processing, the arrangement of the attachment unit 15, the first heating unit 21, and the second heating unit 22 is controlled to be the first arrangement, and the reaction solution 140 is held in the first region 111. The temperature T1 of the first heating unit 21 in the third processing is the temperature at which the reverse transcriptase enzyme has activity, and the reverse transcription reaction progresses. Thus, according to the embodiment, the temperature T2 of the second heating unit 22 for heating the second region 112 may be changed from the second temperature to the third temperature using the time when the reaction solution 140 is held in the first region 111. Therefore, when the arrangement of the attachment unit 15, the first heating unit 21, and the second heating unit 22 is controlled to be the second arrangement in the second processing, the reverse transcriptase enzyme may be promptly deactivated.

After step S104, the control unit 40 determines whether or not a first period has elapsed (step S106). The first period is a period necessary from when the reaction container 100 is attached to the attachment unit 15 to when the reverse transcription reaction is sufficiently performed within the reaction container 100. In the example shown in FIG. 8, 15 minutes are employed for the first period. The measurement start time of the first period may be, for example, a time when an operation of the user is received via an operation receiving means (not shown) (for example, a signal receiving unit that receives a communication signal from a button, a lever, a computer, or the like) after the user has attached the reaction container 100 to the attachment unit 15. Further, for example, the measurement start time of the first period may be a time determined based on a detection result of a detecting means (not shown) (for example, an optical sensor, a contact sensor, a switch, or the like) for detecting whether or not the reaction container 100 has been attached to the attachment unit 15. If the control unit 40 determines that the first period has not elapsed (if NO at step S106), step S106 is repeated. If the control unit 40 determines that the first period has elapsed (if YES at step S106), step S108 to be described later is performed.

Note that, at step S104 and step S106, the arrangement of the attachment unit 15, the first heating unit 21, and the second heating unit 22 is the first arrangement, and the reaction solution 140 is held in the first region 111. Accordingly, the solution is not affected by the temperature T2 of the second heating unit 22. Therefore, in FIG. 7, for convenience, the example in which step S106 is performed after step S104 has been explained, however, the measurement start time of the first period may be before step S104. Further, the order of step S104 and step S106 may be reversed. In the example shown in FIG. 8, both the measurement start time of the first period and the start time of step S104 are the same, time "0". Note that the period before the time "0" (the period in which the time is negative in FIG. 8) corresponds to the period for attachment of the reaction container 100 to the attachment unit 15.

After step S106, the control unit 40 controls second processing of controlling the drive mechanism 30 so that the arrangement of the attachment unit 15, the first heating unit 21, and the second heating unit 22 may be the second arrangement and controlling the temperature of the second heating unit 22 to be the temperature at which the reverse transcriptase enzyme is deactivated (third temperature).

In the second processing, the arrangement of the attachment unit 15, the first heating unit 21, and the second heating unit 22 is controlled to be the second arrangement, and the reaction solution 140 is held in the second region. That is, the reaction solution 140 is at the third temperature as the temperature at which the reverse transcriptase enzyme is deactivated. Therefore, according to the embodiment, the reverse transcriptase enzyme may be deactivated by moving the reaction solution 140 to the second region of the reaction container 100. Thus, the time taken for the case of transfer from the reverse transcription reaction to the thermal cycling of polymerase chain reaction may be made shorter than that in the case where the temperature T1 of the first heating unit is changed to the temperature at which the reverse transcriptase enzyme is deactivated.

When PCR is performed after reverse transcription reaction (for example, when the 1step RT-PCR explained in this section is performed), the control unit 40 may control the temperature T1 of the first heating unit 21 to the annealing and elongation temperature (fourth temperature) in polymerase chain reaction (PCR) in the second processing (step S108).

"The annealing and elongation temperature in polymerase chain reaction (PCR)" refers to a temperature depending on primer for amplification of nucleic acid, and generally within a range from 50° C. to 70° C. In the example shown in FIG. 8, 60° C. is employed as the fourth temperature.

In the second processing, the arrangement of the attachment unit 15, the first heating unit 21, and the second heating unit 22 is controlled to be the second arrangement, and the reaction solution 140 is held in the second region 112. Thus, according to the embodiment, the temperature T1 of the first heating unit 21 for heating the first region 111 may be changed from the first temperature to the fourth temperature using the time when the reaction solution 140 is held in the second region 112. Therefore, the time taken for the case of transfer from the reverse transcription reaction to the thermal cycling of polymerase chain reaction may be made shorter than that in the case where the temperature of the first heating unit 21 is changed to the annealing and elongation temperature after the second processing.

In the example shown in FIG. 8, at the time when the temperature T1 of the first heating unit 21 is controlled to be the fourth temperature (time t), the arrangement of the attachment unit 15, the first heating unit 21, and the second heating unit 22 is switched from the first arrangement to the second arrangement. Therefore, in the example shown in FIG. 8, the period from time 0 to time t corresponds to the period in which the reverse transcription reaction is performed, and the period after the time t corresponds to the period in which PCR is performed.

The control unit 40 may control the drive mechanism 30 so that the arrangement of the attachment unit 15, the first heating unit 21, and the second heating unit 22 may be the first arrangement after the second processing (step S108).

According to the embodiment, the arrangement of the attachment unit 15, the first heating unit 21, and the second heating unit 22 is controlled to be the first arrangement after the second processing, and thus, the period in which the reaction solution 140 is held at the annealing and elongation temperature may be controlled more accurately than that in the case where the temperature T1 of the first heating unit 21 is controlled to be the annealing and elongation temperature after switching to the first arrangement.

The temperature at which the reverse transcriptase enzyme is deactivated (third temperature) may be a thermal denaturation temperature in polymerase chain reaction PCR. That is, the third temperature may be the temperature at which the reverse transcriptase enzyme is deactivated and the temperature as the thermal denaturation temperature in PCR.

"Thermal denaturation temperature in Polymerase chain reaction PCR" is a temperature in which the double stranded DNA is dissociated into the single stranded DNA, and generally within a range from 90° C. to 100° C. In the example shown in FIG. 8, 95° C. is employed as the third temperature, and the temperature is the temperature at which the reverse transcriptase enzyme is deactivated and the temperature as the thermal denaturation temperature in PCR.

According to the embodiment, when the arrangement of the attachment unit 15, the first heating unit 21, and the second heating unit 22 is controlled to be the second arrangement, the reaction solution 140 is held in the second region 112 controlled at the temperature at which the reverse transcriptase enzyme is deactivated and the thermal denaturation temperature of DNA in the polymerase chain reaction. Thereby, the deactivation of the reverse transcriptase enzyme and the thermal denaturation in the polymerase chain reaction may be performed at the same step. Therefore, the time taken for the case of transfer from the reverse transcription reaction to the thermal cycling of polymerase chain reaction may be made shorter than that in the case where the temperatures of the deactivation and the thermal denaturation of the reverse transcriptase enzyme are different. Further, in 1step RT-PCR, generally, hot start PCR enzyme (PCR enzyme that is activated when subjected to a predetermined temperature) is used. The temperature at which the hot start PCR enzyme is activated is generally within the common temperature range with the thermal denaturation temperature. Therefore, using the third temperature as the temperature at which the reverse transcriptase enzyme is deactivated and the thermal denaturation temperature of DNA, the hot start step may be performed at the same step.

In FIG. 7, after step S108, the control unit 40 determines whether or not a second period has elapsed (step S110). The second period is a period necessary for deactivation of the reverse transcriptase enzyme and hot start of PCR. In the embodiment, ten seconds are employed for the second period. If the control unit 40 determines that the second period has not elapsed (if NO at step S110), step S110 is repeated.

If the control unit 40 determines that the second period has elapsed (if YES at step S110), thermal cycling processing is performed (step S112). In the embodiment, the control unit 40 performs the thermal cycling processing by switching the arrangement of the attachment unit 15, the first heating unit 21 and the second heating unit 22 between the first arrangement and the second arrangement in a desired period to a desired number of times. In the example shown in FIG. 7, at step S108, the temperature T1 of the first heating unit 21 is controlled to be the fourth temperature as the annealing and elongation temperature in PCR, and the temperature T2 of the second heating unit 22 is controlled to be the third temperature as the thermal denaturation temperature in PCR. Therefore, when the arrangement of the attachment unit 15, the first heating unit 21, and the second heating unit 22 is the first arrangement, the reaction solution 140 is held in the first region 111 at the fourth temperature, and, when the arrangement of the attachment unit 15, the first heating unit 21, and the second heating unit 22 is the second arrangement, the reaction solution 140 is held in the second region 112 at the third temperature. Thereby, desired thermal cycling necessary for PCR may be applied to the reaction solution 140.

Figure 9:
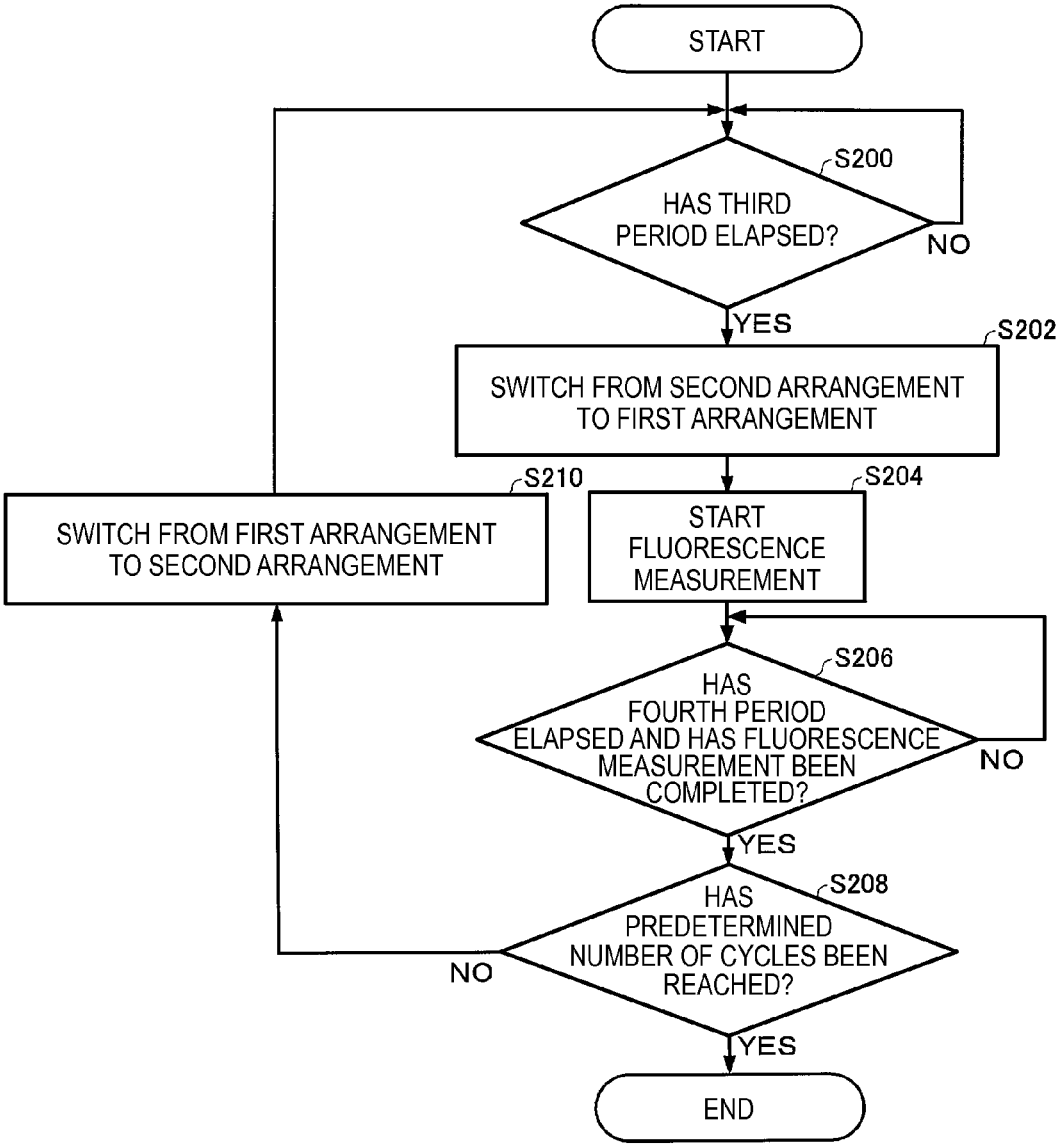
FIG. 9 is a flowchart for explanation of an example of thermal cycling processing.

FIG. 9 is a flowchart for explanation of an example of thermal cycling processing. Note that, at step S108 of FIG. 7, the temperature T1 of the first heating unit 21 is controlled to be the fourth temperature as the annealing and elongation temperature in PCR, and the temperature T2 of the second heating unit 22 is controlled to be the third temperature as the thermal denaturation temperature in PCR. Further, at the start of the thermal cycling processing, the arrangement of the attachment unit 15, the first heating unit 21, and the second heating unit 22 is the second arrangement. That is, the reaction solution 140 is held in the second region 112 at the third temperature.

In FIG. 9, first, the control unit 40 determines whether or not a third period has elapsed (step S200). The third period is a period necessary for thermal denaturation in PCR. In the embodiment, five seconds are employed for the third period. If the control unit 40 determines that the third period has not elapsed (if NO at step S200), step S200 is repeated.

If the control unit 40 determines that the third period has elapsed (if YES at step S200), the control unit 40 controls the drive mechanism 30 to switch the arrangement of the attachment unit 15, the first heating unit 21, and the second heating unit 22 from the second arrangement to the first arrangement (step S202). Thereby, the reaction solution 140 moves to the first region 111 at the fourth temperature.

After step S202, fluorescence measurement is started (step S204). The fluorescence measurement with respect to plural reaction containers 100 may be performed by moving the measurement unit 50 on the slide 52.

After step S204, the control unit 40 determines whether or not a fourth period has elapsed and the fluorescence measurement has been completed (step S206). The fourth period is a period necessary for annealing and elongation in PCR. In the embodiment, 30 seconds are employed for the fourth period. If the control unit 40 determines that the fourth period has not elapsed or the fluorescence measurement has not been completed (if NO at step S206), step S206 is repeated.

If the control unit 40 determines that the fourth period has elapsed and the fluorescence measurement has been completed (if YES at step S206), the control unit 40 determines whether or not a predetermined number of cycles has been reached (step S208). In the embodiment, 50 is employed as the predetermined number of cycles.

If the control unit 40 determines that the predetermined number of cycles has not been reached (if NO at step S208), the control unit 40 controls the drive mechanism 30 to switch the arrangement of the attachment unit 15, the first heating unit 21, and the second heating unit 22 from the first arrangement to the second arrangement (step S210). After step S210, step S200 to step S208 are repeated. If the control unit 40 determines that the predetermined number of cycles has been reached (if YES at step S208), the thermal cycling processing is ended.

4. Example

As below, the invention will be more specifically explained using an example, however, the invention is not limited to the example.

FIG. 10 is a table showing a composition of the reaction solution 140 in the example. In FIG. 10, "SuperScript III Platinum" refers to "SuperScript III Platinum One-Step Quantitative RT-PCR System with ROX ("Platinum" is a registered trademark, manufactured by Life Technologies"), and contains PCR enzyme and reverse transcriptase enzyme. As RNA, RNA extracted from a human nasal cavity swab (human sample) was used. Note that, regarding the human sample, immuno chromatography was performed using a commercially available kit ("ESPLINE Influenza A&B-N) (ESPLINE is a registered trademark)", manufactured by FUJIREBIO), and the sample was positive for influenza A virus. Note that "A virus positive" in immuno chromatography does not specifically determine the influenza A virus (InfA).

FIG. 11 is a table showing base sequences of forward primers (F primers), reverse primers (R primers), and probes corresponding to influenza A virus (InfA), swine influenza A virus (SW InfA), and swine influenza H1 virus (SW H1), ribonuclease P (RNase P). All of them are the same as base sequences described in "CDC protocol of realtime RTPCR for swine influenza A (H1N1)" (World Health Organization, Revised First Edition, Apr. 30, 2009). In all of the four types of probes shown in FIG. 11, fluorescent brightness to be measured increases with amplification of nucleic acid.

The experimental procedure was as shown in the flowcharts in FIGS. 7 and 9, and the first temperature was 45° C., the second temperature was 58° C., the third temperature was 98° C., the first period was 60 seconds, the second period was ten seconds, the third period was five seconds, the fourth period was 30 seconds, and the number of cycles of the thermal cycling processing was 50. Further, the number of reaction containers 100 attached to the attachment unit 15 was four (Sample A to Sample D).

Sample A contains a forward primer, a reverse primer, and a fluorescent probe corresponding to influenza A virus. Sample B contains a forward primer, a reverse primer, and a fluorescent probe corresponding to swine influenza A virus (SW InfA). Sample C contains a forward primer, a reverse primer, and a fluorescent probe corresponding to swine influenza HI virus (SW H1). Sample D contains a forward primer, a reverse primer, and a fluorescent probe corresponding to ribonuclease P (RNase P).

Figure 12:
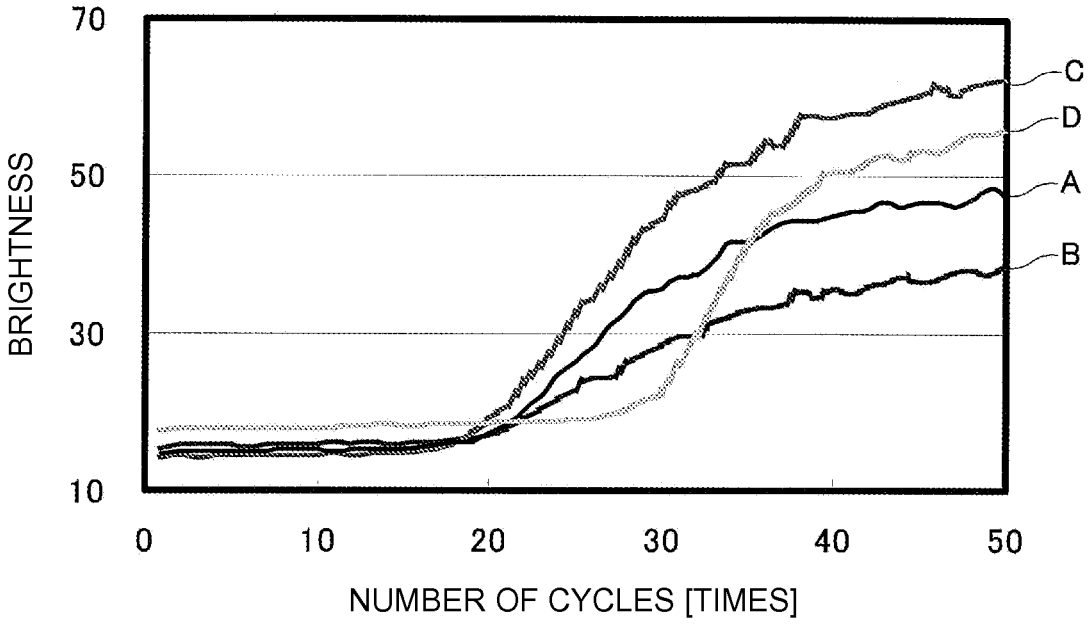
FIG. 12 is a graph showing relationships between the number of cycles of thermal cycling processing and measured brightness.

FIG. 12 is a graph showing relationships between the number of cycles of thermal cycling processing and measured brightness in the Example. The horizontal axis of FIG. 12 indicates the number of cycles of the thermal cycling processing and the vertical axis indicates the relative value of brightness.

As shown in FIG. 12, it is known that, regarding all of Sample A to Sample D, the brightness significantly rose as the number of cycles of the thermal cycling processing was about 20 to 30. Thereby, it is known that reverse-transcribed cDNA with RNA as the template has been amplified. Sample D was for an experiment of endogenous control, and it is confirmed that DNA (cDNA) derived from the human sample has been amplified because the brightness rose in Sample D. Further, it is known that all RNAs of InfA, SW InfA, SW H1 have been contained in the human sample because cDNA has been amplified in Sample A to Sample D. The result agrees with the result of immuno chromatography. Therefore, it has been confirmed that 1step RT-PCR may be performed using the thermal cycler 1 according to the embodiment. That is, it has been confirmed that, according to the thermal cycler 1 and the control method of the thermal cycler 1 of the embodiment, deactivation of reverse transcriptase enzyme may be suppressed and reaction accuracy is good.

Note that the above described embodiment and example are just examples, and not limited to those. For example, some of the respective embodiments and the respective examples may be appropriately combined.

The invention is not limited to the above described embodiment and example, but other various modifications may be made. For example, the invention includes substantially the same configuration as the configuration explained in the embodiment (for example, a configuration having the same function, method, and result, or a configuration having the same purpose and advantage). Further, the invention includes a configuration in which an insubstantial part of the configuration explained in the embodiment is replaced. Furthermore, the invention includes a configuration that exerts the same effect or a configuration that may achieve the same purpose as that of the configuration explained in the embodiment. In addition, the invention includes a configuration formed by adding a known technology to the configuration explained in the embodiment.

The entire disclosure of Japanese Patent Application No. 2012-079764, filed Mar. 30, 2012 is expressly incorporated by reference herein.

SEQUENCE LISTING

```
<160> NUMBER OF SEQ ID NOS: 12

<210> SEQ ID NO 1
<211> LENGTH: 22
<212> TYPE: DNA
<213> ORGANISM: Artificial Sequence
<220> FEATURE:
<223> OTHER INFORMATION: InfA Forward primer

<400> SEQUENCE: 1

gatcratcct gtcacctctg ac                                              22


<210> SEQ ID NO 2
<211> LENGTH: 24
<212> TYPE: DNA
<213> ORGANISM: Artificial Sequence
<220> FEATURE:
<223> OTHER INFORMATION: InfA Reverse primer

<400> SEQUENCE: 2

agggcattyt ggacaaakcg tcta                                            24


<210> SEQ ID NO 3
<211> LENGTH: 24
<212> TYPE: DNA
<213> ORGANISM: Artificial Sequence
<220> FEATURE:
<223> OTHER INFORMATION: InfA Fluorescent probe

<400> SEQUENCE: 3

tgcagtcctc gctcactggg cacg                                            24


<210> SEQ ID NO 4
<211> LENGTH: 23
<212> TYPE: DNA
<213> ORGANISM: Artificial Sequence
<220> FEATURE:
<223> OTHER INFORMATION: SW InfA Forward primer

<400> SEQUENCE: 4

gcacggtcag cacttatyct rag                                             23


<210> SEQ ID NO 5
<211> LENGTH: 23
<212> TYPE: DNA
<213> ORGANISM: Artificial Sequence
<220> FEATURE:
<223> OTHER INFORMATION: SW InfA Reverse primer

<400> SEQUENCE: 5

gtgrgctggg ttttcatttg gtc                                             23


<210> SEQ ID NO 6
<211> LENGTH: 29
<212> TYPE: DNA
```

<213> ORGANISM: Artificial Sequence
<220> FEATURE:
<223> OTHER INFORMATION: SW InfA Fluorescent probe

<400> SEQUENCE: 6 cyactgcaag cccatacaca caagcagca 29

<210> SEQ ID NO 7
<211> LENGTH: 23
<212> TYPE: DNA
<213> ORGANISM: Artificial Sequence
<220> FEATURE:
<223> OTHER INFORMATION: SW H1 Forward primer

<400> SEQUENCE: 7 gtgctataaa caccagccty cca 23

<210> SEQ ID NO 8
<211> LENGTH: 24
<212> TYPE: DNA
<213> ORGANISM: Artificial Sequence
<220> FEATURE:
<223> OTHER INFORMATION: SW H1 Reverse primer

<400> SEQUENCE: 8 cgggatattc cttaatcctg trgc 24

<210> SEQ ID NO 9
<211> LENGTH: 30
<212> TYPE: DNA
<213> ORGANISM: Artificial Sequence
<220> FEATURE:
<223> OTHER INFORMATION: SW H1 Fluorescent probe

<400> SEQUENCE: 9 cagaatatac atccrgtcac aattggaraa 30

<210> SEQ ID NO 10
<211> LENGTH: 19
<212> TYPE: DNA
<213> ORGANISM: Artificial Sequence
<220> FEATURE:
<223> OTHER INFORMATION: RNaseP Forward primer

<400> SEQUENCE: 10 agatttggac ctgcgagcg 19

<210> SEQ ID NO 11
<211> LENGTH: 20
<212> TYPE: DNA
<213> ORGANISM: Artificial Sequence
<220> FEATURE:
<223> OTHER INFORMATION: RNaseP Reverse primer

<400> SEQUENCE: 11 gagcggctgt ctccacaagt 20

<210> SEQ ID NO 12
<211> LENGTH: 23
<212> TYPE: DNA
<213> ORGANISM: Artificial Sequence
<220> FEATURE:
<223> OTHER INFORMATION: RNaseP Fluorescent probe -continued

<400> SEQUENCE: 12 ttctgacctg aaggctctgc gcg 23

What is claimed is:

1. A thermal cycler comprising:

an attachment unit that rotates along a rotational axis, the attachment unit having an insertion opening for insertion of a reaction container including a channel filled with a reaction solution containing reverse transcriptase enzyme and a liquid having a lower specific gravity than that of the reaction solution and being immiscible with the reaction solution, the reaction solution moving close to opposed inner walls;

a first heating unit that heats a first region of the channel when the reaction container is attached to the attachment unit, the first heating unit being positioned at a first distance located radially outward from the rotational axis;

a second heating unit that heats a second region of the channel nearer the insertion opening than the first region when the reaction container is attached to the attachment unit, the second heating unit being positioned at a second distance located radially outward from the rotational axis;

a drive mechanism that switches arrangement of the attachment unit, the first heating unit, and the second heating unit between a first arrangement and a second arrangement; and a control unit that controls the first heating unit and the second heating unit, wherein the rotational axis is located between the first heating unit and the second heating unit, the first arrangement is an arrangement in which the first region is located in a lowermost part of the channel in a direction in which gravity acts and below the rotational axis when the reaction container is attached to the attachment unit, the second arrangement is an arrangement in which the second region is located in the lowermost part of the channel in the direction in which the gravity acts and below the rotational axis when the reaction container is attached to the attachment unit, and the control unit performs first processing of controlling the drive mechanism so that the arrangement of the attachment unit, the first heating unit and the second heating unit is the first arrangement and controlling a temperature of the first heating unit to be a temperature at which the reverse transcriptase enzyme has activity and controlling a temperature of the second heating unit to be a temperature at which the reverse transcriptase enzyme is not deactivated, wherein the control unit further controls the drive mechanism, and performs second processing of controlling the drive mechanism so that the arrangement of the attachment unit, the first heating unit, and the second heating unit is the second arrangement and controlling the temperature of the second heating unit to be a temperature at which the reverse transcriptase enzyme is deactivated after the first processing.

2. The thermal cycler according to claim 1, wherein the control unit performs third processing of controlling the drive mechanism so that the arrangement of the attachment unit, the first heating unit, and the second heating unit is the first arrangement, and controlling the temperature of the first heating unit to be the temperature at which the reverse transcriptase enzyme has activity and controlling the temperature of the second heating unit to be the temperature at which the reverse transcriptase enzyme is deactivated after the first processing and before the second processing.

3. The thermal cycler according to claim 1, wherein the control unit controls the temperature of the first heating unit to be an annealing and elongation temperature in polymerase chain reaction in the second processing.

4. The thermal cycler according to claim 3, wherein the control unit controls the drive mechanism so that the arrangement of the attachment unit, the first heating unit, and the second heating unit is the first arrangement after the second processing.

5. The thermal cycler according to claim 3, wherein the temperature at which the reverse transcriptase enzyme has activity is a thermal denaturation temperature in polymerase chain reaction.

6. A control method of a thermal cycler, the thermal cycler including an attachment unit that rotates along a rotational axis, the attachment unit having an insertion opening for insertion of a reaction container including a channel filled with a reaction solution containing reverse transcriptase enzyme and a liquid having a lower specific gravity than that of the reaction solution and being immiscible with the reaction solution, the reaction solution moving close to opposed inner walls, a first heating unit that heats a first region of the channel when the reaction container is attached to the attachment unit, the first heating unit being positioned at a first distance located radially outward from the rotational axis, a second heating unit that heats a second region of the channel nearer the insertion opening than the first region when the reaction container is attached to the attachment unit, the second heating unit being positioned at a second distance located radially outward from the rotational axis, and a drive mechanism that switches arrangement of the attachment unit, the first heating unit, and the second heating unit between a first arrangement and a second arrangement, the rotational axis being located between the first heating unit and the second heating unit, the first arrangement being an arrangement in which the first region is located in a lowermost part of the channel in a direction in which gravity acts and below the rotational axis when the reaction container is attached to the attachment unit, and the second arrangement being an arrangement in which the second region is located in the lowermost part of the channel in the direction in which the gravity acts and below the rotational axis when the reaction container is attached to the attachment unit, the control method comprising:

the control unit performs first processing of controlling the drive mechanism so that the arrangement of the attachment unit, the first heating unit and the second heating unit is the first arrangement and controlling a temperature of the first heating unit to be a temperature at which the reverse transcriptase enzyme has activity, and controlling a temperature of the second heating unit to be a temperature at which the reverse transcriptase enzyme is not deactivated, wherein the control unit further controls the drive mechanism, and performs second processing of controlling the drive mechanism so that the arrangement of the attachment unit, the first heating unit, and the second heating unit is the second arrangement and controlling the temperature of the second heating unit to be a temperature at which the reverse transcriptase enzyme is deactivated after the first processing.

* * * * *